US005511970A

United States Patent [19]

Irwin et al.

[11] Patent Number: 5,511,970

[45] Date of Patent: Apr. 30, 1996

[54] COMBINATION BURNER WITH PRIMARY AND SECONDARY FUEL INJECTION

[75] Inventors: Bruce C. Irwin, Palmyra; Edward E. Moore, Hummelstown; Raymond F. Baum, Lebanon, all of Pa.

[73] Assignee: Hauck Manufacturing Company, Lebanon, Pa.

[21] Appl. No.: 188,406

[22] Filed: Jan. 24, 1994

[51] Int. Cl.[6] ..... F23D 17/00

[52] U.S. Cl. ..... 431/9; 431/8; 431/188; 431/285; 431/284

[58] Field of Search ..... 431/278, 285, 431/284, 283, 8, 9, 181, 182, 183, 187, 188

[56] References Cited

U.S. PATENT DOCUMENTS

| | | | |
|---|---|---|---|
| 2,822,864 | 2/1958 | Black | 431/284 X |
| 3,163,203 | 12/1964 | Ihlenfield . | |
| 3,217,779 | 11/1965 | Reed et al. . | |
| 3,391,981 | 7/1968 | Voorheis et al. . | |
| 4,162,140 | 7/1979 | Reed | 431/284 |
| 4,239,481 | 12/1980 | Mock, Jr. | 431/284 |
| 4,298,337 | 11/1981 | Butler et al. . | |
| 4,389,188 | 6/1983 | Kamath | 431/284 |
| 4,441,879 | 4/1984 | Wagner et al. . | |
| 4,451,230 | 5/1984 | Bocci et al. . | |
| 4,559,009 | 12/1985 | Marino et al. . | |
| 4,717,332 | 1/1988 | Edens . | |
| 4,859,173 | 8/1989 | Davis, Jr. et al. . | |
| 5,009,174 | 4/1991 | Polak . | |
| 5,259,755 | 11/1993 | Irwin et al. | 431/182 X |

FOREIGN PATENT DOCUMENTS

| | | | |
|---|---|---|---|
| 2809114 | 9/1979 | Germany | 431/284 |
| 7408466 | 12/1974 | Netherlands | 431/284 |

*Primary Examiner*—Carl D. Price

*Attorney, Agent, or Firm*—Evenson, McKeown, Edwards & Lenahan

[57] ABSTRACT

A burning method provides a versatile burner by promoting rapid mixing and a stable flame to reduce $NO_x$ and CO emissions over a wide operating range. The burner includes a primary fuel supply, a combustion air supply arranged to supply combustion air at low pressure, and a swirler for swirling the combustion air. When the primary fuel supply is gaseous fuel, the gaseous fuel is introduced axially into the swirling combustion air. Secondary gas nozzles are arranged at the exit of the burner to supply and mix boost gas for combustion with the combustion air when the gaseous fuel is the primary fuel supply. An atomizer is arranged for atomizing liquid fuel when the primary fuel supply is a liquid fuel.

13 Claims, 5 Drawing Sheets

COMBINATION BURNER WITH PRIMARY AND SECONDARY FUEL INJECTION

BACKGROUND AND SUMMARY OF THE INVENTION

The present invention relates to an improved burner and burner method used, for example, in the production of asphalt and, in particular, to a versatile burner of simplified construction which promotes more complete mixing of fuel and air over a wide range of operating conditions and which utilizes a unique combination of primary and secondary fuel injection when the burner uses gaseous fuel as well as liquid propane and butane.

Combination fuel aggregate dryer burners are disclosed, for example, in U.S. Pat. Nos. 4,559,009 and 4,298,337 as discussed in commonly assigned U.S. Pat. No. 5,259,755, which discussion is incorporated by reference herein. Many other burners are also currently available or known for the combustion of gas, liquid fuel and combinations thereof as shown, for example, in U.S. Pat. Nos. 3,163,203; 3,217,779; 3,391,981; 4,441,879; 4,451,230; 4,717,332; 4,859,173; and 5,009,174.

It is a goal of all these burners to provide a compact and efficient combustion burner, large turn-down ratio, flame stability, ability to switch between fuels, dependable operation and economical manufacture. The combustion burner shown, for example, in the above-mentioned U.S. Pat. No. 3,163,203, swirls a liquid fuel/air mixture through vane slots into a combustion chamber and the gaseous fuel is passed through axially-disposed nozzles where it is then mixed with the swirling air.

Due to the unique problems and operating conditions associated with the production of asphalt, however, these known burners and others constructed specifically for the asphalt production operation are unduly complicated in their constructional features and do not perform satisfactorily under all conditions. They also lack other advantages and features such as the ability to provide increased turn down at low fire and extremely stable and intense combustion throughout the burner's firing range in a simple way so as to reduce emissions without, for instance, the need for a compressed air source.

As discussed in U.S. Pat. No. 5,259,755, we found that the known burners used in the asphalt industry do not satisfactorily enhance and protect the base of a flame recirculation zone under oil flame. In addition, whereas the prior burners used in asphalt production are known for use with refractory burner block or for use in a refractory-less application, these burners do not provide a satisfactory arrangement for use both with and without refractory burning block depending on which is required based on the desired use temperature. That is, thermal oxidizers and other applications that these known burners could be used for require a higher operating temperature and also might require a refractory tile. Although the combination burner described in U.S. Pat. No. 5,259,755 constitutes a substantial improvement over previously known burners, we found that in the typical dusty environments encountered in asphalt production resulted in incomplete combustion under certain operating conditions. This, in turn, results in too much combustion occurring outside the combustion chamber with leftover combustibles.

An object of the present invention is, therefore, to provide a new, even more versatile burner and burning method which constitutes an improvement over the burner described in U.S. Pat. No. 5,259,755 and which provides more complete mixing of fuel and air over a wider range of operating conditions, particularly in the production of asphalt, in contrast with the known burners wherein only a portion of the air, about one-third of the total volume, has the fuel injected thereinto.

Another object of the present invention is to provide more complete mixing of the fuel and air to obtain more rapid combustion or combustion intensity (i.e., the BTU output per hour divided by the combustion space) for reducing the overall burner size and lowering CO emissions in a given combustion space before the flame leaves the combustion zone of the dryer.

Yet a further object of the present invention is to provide a burner which encourages internal recirculation through swirl to promote more rapid and complete combustion and to achieve $NO_x$ levels of lowest possible amount with very high combustion intensity and low $O_2$ levels.

Still a further object of the present invention is to provide a burner which produces a lower noise level and which will run smoother with less resonance in the duct work and drums due to a more stable flame with less pulsing.

A further object of the present invention is to provide a burner which requires lower horsepower than previous burners of the same BTU capacity.

A still further object of the present invention is to provide a burner which can be adapted to industrial and high temperature applications where optional refractory burner tile is used for use in refractory lined combustion chambers such as incinerators.

Still another object of the present invention is the provision of a burner having a wider flame than previously obtained which is particularly advantageous with the use of large diameter drums in the production of asphalt.

These objects have been achieved in accordance with the present invention by the provision of a total air burner in which all the air passes through adjustable spin vanes and the fuel is injected into the entire airstream, rather than separating combustion air into two different streams with the fuel injected into only a portion thereof.

Another feature of the present invention is that it produces a wider flame than conventional asphalt burners with the same firing lengths at 50% and 100% firing. This has an advantage over narrower and longer flames of known burners for customers that have large diameter drums.

As a result of the foregoing, a more versatile burner has been produced which uses a burning method usable over a wider range of operating conditions than previously available burners were able to achieve due to its simplified constructional principles using a unique combination of primary and secondary fuel injection when using gaseous and liquid propane and butane to achieve complete combustion and flame stability. Because the burner in accordance with the present invention is inserted only slightly into the drum, it can run with a cooler aggregate dryer breach plate. Furthermore, the burner in accordance with the present invention, like the burner described in U.S. Pat. No. 5,259,755, uses less horsepower than open fired burners of similar BTU capacity and can be used also in industrial and high temperature applications with refractory burner tile in refractory-lined combustion chambers such as incinerators.

BRIEF DESCRIPTION OF THE DRAWINGS

These and other features, objects, and advantages of the present invention will become more readily apparent from the following detailed description of a currently preferred embodiment of the present invention when taken in conjunction with the accompanying drawings wherein.

DETAILED DESCRIPTION OF THE DRAWINGS

Figure 1:
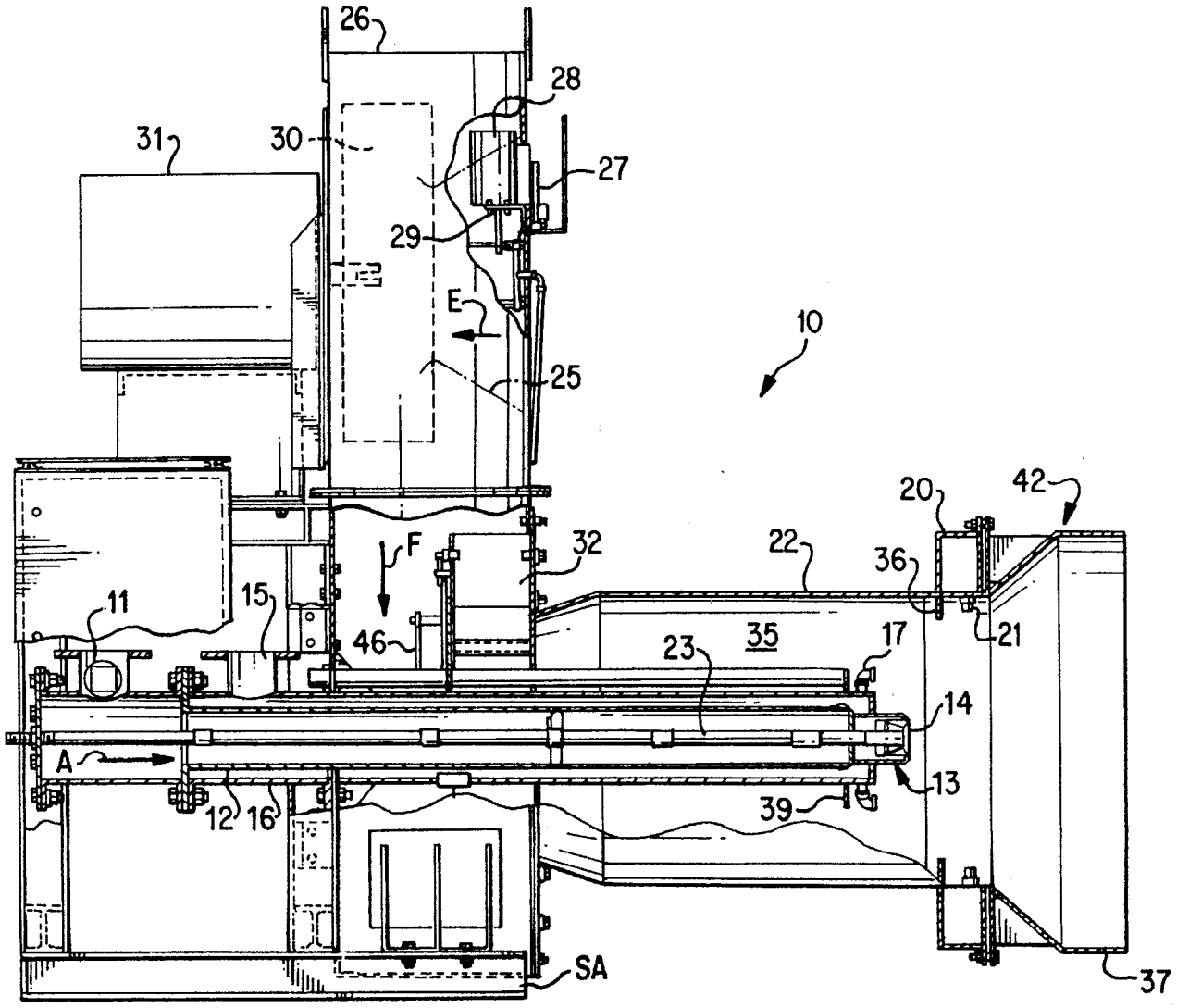
FIG. 1 is a partially cut-away side elevational view of the burner according to the present invention.

Referring now to the drawings and, in particular, to FIG. 1, the burner utilizing the principle of the present invention is designated generally by the numeral 10 and is partially cut away to show those internal parts important to the invention. To the extent parts similar to the burner described below are also shown and described in U.S. Pat. No. 5,259,755, which has been incorporated by reference herein, a detailed description thereof is dispensed with herein.

Figure 3:
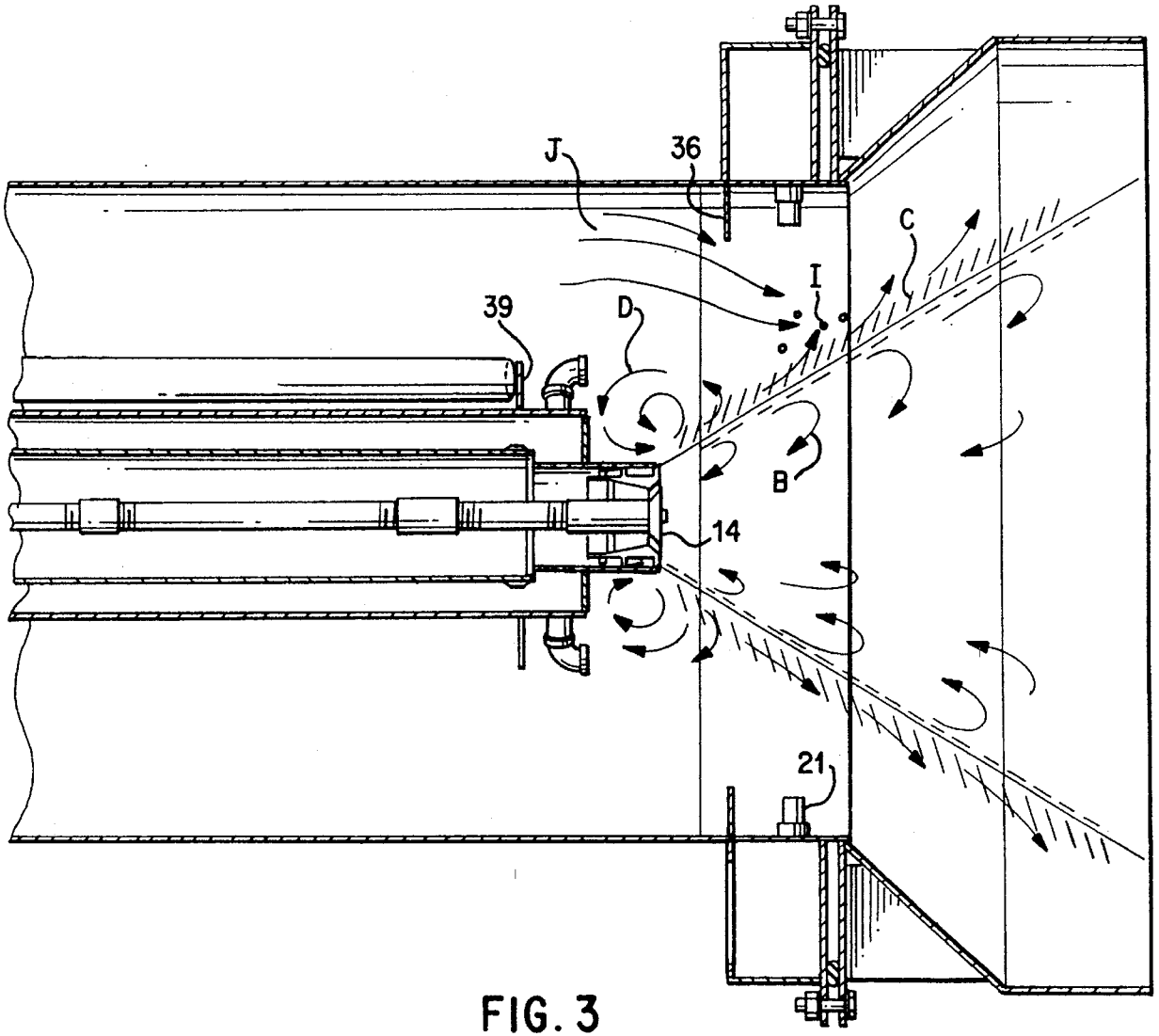
FIG. 3 is a cut away detail view of the outlet end of the burner of FIG. 1 showing oil flame and recirculation patterns when the burner is "on oil"

The burner 10 is arranged on a skid assembly SA and has an inlet 11 for admission of primary (atomizing) air. By way of example only, the pressure of the primary combustion air is 36 OSI. The primary air, whose direction is indicated by arrow A flows through a passage constituted by an assembly having a primary air tube 12 in the burner 10 and then through a conventional spin-baffle prefilming atomizer assembly designated generally by the numeral 13. The oil atomizer assembly 13 is of the known type currently sold by applicants' assignee, Hauck Manufacturing Company of Lebanon, Pa., and produces a subatmospheric primary flame recirculation zone immediately in front of a face 14 of the atomizer 13 as shown by the arrows B in FIG. 3. This recirculation zone B, which can be seen when a flame is present, is established even with gaseous fuels, as shown by the arrows B' in FIG. 5, because of the strong spin and baffle effect of the atomizer 13 on the primary (atomizing) air A.

Figure 2:
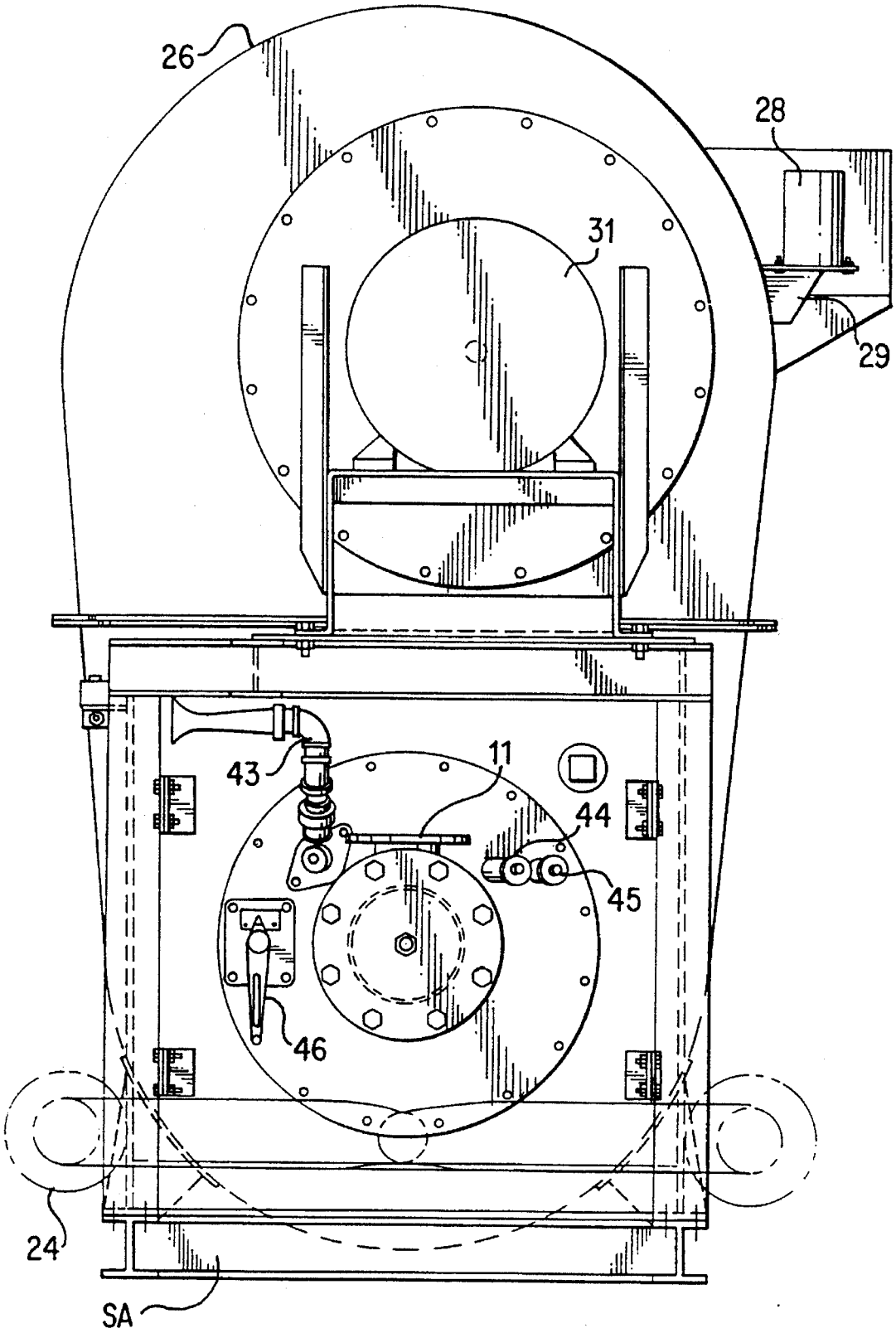
FIG. 2 is an end view of the burner shown in FIG. 1.
Figure 4:
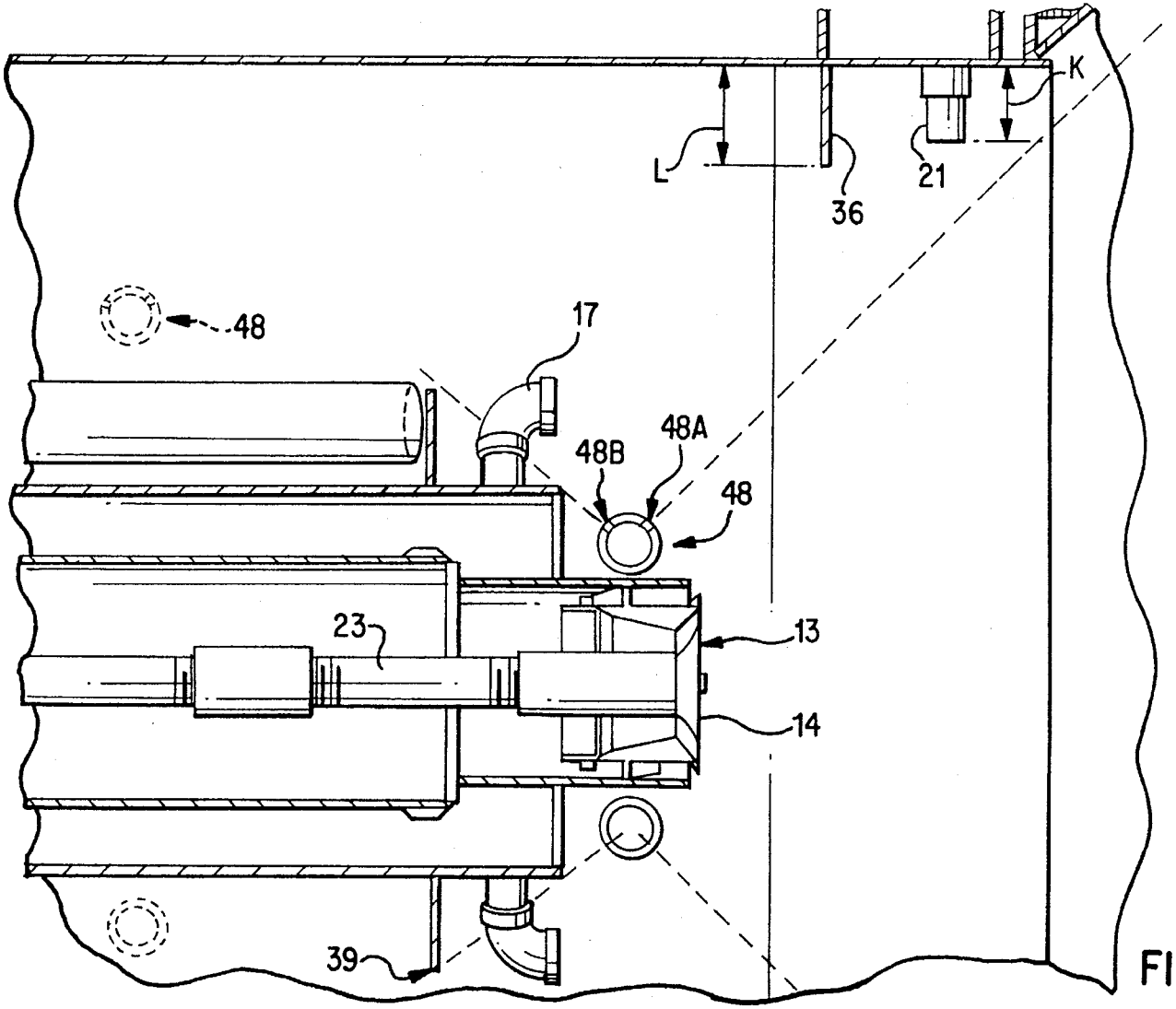
FIG. 4 is an isolated, enlarged view of the oil atomizer for "on oil" operation shown in FIG. 1 and also of a primary gas baffle ring when the burner uses liquid propane or butane.

In the event a fuel other than gas, e.g. oil or liquid propane, is more readily available, the burner 10 can be constructed to burn that fuel by using a baffle ring as shown in FIG. 4 and described below. In the illustrated embodiment of FIGS. 1–3, however, the burner 10 is shown burning oil. Specifically, an oil tube 23 is arranged centrally in the primary air tube 12. The oil passing through the centrally arranged tube 23 is atomized by the atomizer unit 13 (FIG. 3) in a known manner as the oil exits the burner 10. The oil spray designated by the hatched cone C (FIG. 3) leaving the atomizer 13 begins to burn in the primary flame recirculation zone B in a cone-shaped flame (shown in dashed lines) that burns within and outside of the cone-shaped spray C exiting the atomizer 13. Another flame recirculation zone D is formed downstream of an appropriately sized and located center gas (primary) baffle ring 39 to aid in flame stability and to enhance mixing of the oil spray and the combustion air flow.

Figure 5:
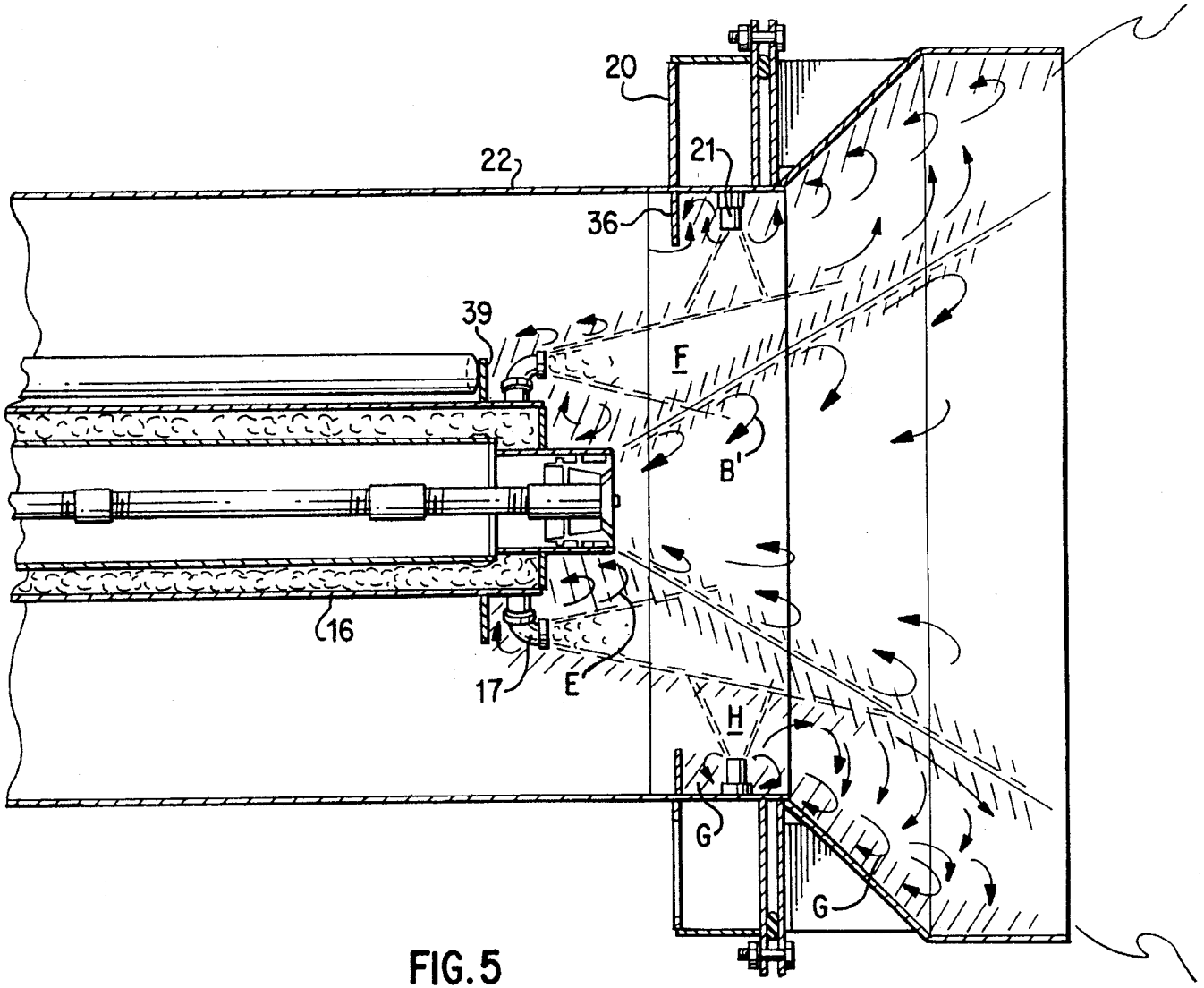
FIG. 5 is a cut away detail view of FIG. 1 similar to FIG. 3 but showing gas flame and recirculation patterns when the burner is "on gas".

For burning "on gas" in the manner shown in FIG. 5, the burner 10 is provided with a center (primary) gas inlet 15 through which gaseous fuel is flowed through an assembly having a gas tube 16 and discharges into multiple center primary gas flow nozzles 17 that are circumferentially arranged to evenly distribute and direct the center (primary) gas flow axially into the burner throat. Two such nozzles 17 are shown in the embodiment of FIG. 5 but, in fact, eight nozzles are evenly circumferentially arranged in that embodiment. These center (primary) gas nozzles 17 are arranged to inject the primary gas jets F (FIG. 5) into the primary air recirculation zone B which encourages mixing of the center (primary) gas fuel flow with the combustion air stream flowing down the burner body tube 22. Burner stability and mixing of fuel and air is further enhanced by another primary gas flame recirculation zone (or flame anchor) formed around the center (primary) gas flow nozzles in the backwash downstream of the center (primary) gas baffle ring 39 as shown by arrows E in FIG. 5. If necessary, additional holes (not shown) can be formed in the gas tube 16 to inject the proper amount of gas into the primary gas recirculation zone E.

An outside (secondary) inlet of conventional construction (not shown) allows the entry of secondary gas near the discharge end of burner 10. The secondary gas flows through multiple secondary gas discharge nozzles 21 disposed around the circumference of the burner flame tube 22 shown in more detail in FIG. 5. A total of twenty-four nozzles 21 are used in the embodiment FIG. 5 (although only two are shown for simplicity) and are arranged around the circumference of the inner wall or shell of the flame tube 22 at an annular spacing of two times $\alpha$ (15° in the illustrated embodiment) to directly inject the secondary gas radially toward the centerline of the burner and at 90° to the axial direction of the combustion air flow. This direct injection of secondary gas by the secondary gas nozzles 21 produces fuel jet streams H (FIG. 5) flowing at right angles into the axial component of the combustion air flow and promotes intimate and rapid mixing of fuel and air.

In addition to intimate and rapid mixing, it is essential for proper burner operation to also achieve secondary gas flame recirculation and flame retention. This secondary gas flame recirculation and flame retention is achieved in accordance with one embodiment of the present invention by creation of a properly sized backwash area downstream of an appropriately sized and located body orifice baffle ring 36 in the flow path of the combustion air flowing toward the right in FIG. 5 inside the burner tube 22. This secondary gas flame recirculation area has visible flame and is designated by G (FIG. 5) and forms another flame recirculation anchor zone for the outside (secondary) gas flame development. Moreover, a proper relationship between the height of the secondary gas nozzles 21 designated by the letter K in FIG. 4 and the height of the body orifice baffle ring 36 designated by the letter L is important for proper flame recirculation and mixing speed with the combustion air. For example if K is greater than L, the secondary fuel gas is injected into the air stream but very little if any of the secondary fuel/air mixture will recirculate at G (FIG. 5) and the flame will not be firmly "anchored". Conversely, if K is too small in relation to L, then too much of the fuel gas will recirculate and will either be too rich to burn in area G or the flame shaping cone 42 will run too hot while the fuel air mixing slows down.

Another method to control the amount of secondary fuel gas recirculation in area G is to provide a proper size hole between the secondary gas nozzles 21 to allow a fraction of the fuel gas in area G to escape or be let out while the remainder of the secondary gas is injected directly into the combustion air stream. Flame recirculation and retention areas E, G, and B in FIG. 5 form the flame anchors for gaseous fuel combustion and create a very stable and rapid burning burner capable of a clean short flame for low CO emissions even with staged fuel injection. The normal ratio of primary to secondary fuel is typically 25:75, and results in a full, well defined flame that can be easily shaped from short-and-wide to long-and-thin by varying the combustion air spin vane angle. Substantially higher ratios of primary to secondary air result in longer flames that are rich in the middle, and substantially lower ratios of primary to secondary allows a lean flame center to form that results in hollow cone shaped larger overall flame.

Liquid propane or butane fuels are burned by way of a fuel injection ring 48 (FIG. 4). This ring has holes 48A directed downstream into the air stream for the majority of the fuel flow and upstream facing holes 48B which inject the proper amount of fuel for flame retention in the recirculation zone behind primary gas baffle ring 39. The angle of the holes 48A, 48B are selected to obtain proper mixing speed and flame retention. The holes 48B can be spaced to impinge the fuel which gets onto the primary gas elbow 17. This ring 48 can also be located upstream of the primary gas baffle ring 39 to provide additional time for vaporization prior to entering the flame recirculation zone as shown in dotted lines in FIG. 4.

As seen in FIG. 1, main combustion air enters the burner 10 through a multiple-blade pre-swirl inlet 25 in housing 26. A variable damper 27 arrangement is provided in the inlet 25 and is controlled in a known manner by a damper motor 28 held on the housing 26 by a bracket assembly 29. The main combustion air indicated by arrow E is caused to move into the housing 26 by an impeller 30 driven by a motor 31 and sized to produce a pressure of about 0.5 PSIG. The main combustion air then enters the burner body, as indicated by arrow F, where it flows through spin vane assembly 32 which is adjustable through a lever 46 (FIG. 2) located on the outside of the burner housing to obtain high spin rates even at reduced air flows because the spin vanes serve to reduce the area through the spin vanes over about 50°. At lower air flows, high spin rates, and thus high combustion intensities, can also be achieved since the air pressure drop across the vanes can be maximized at less than maximum flow. The main combustion air passes from the spin vane assembly 32 into the burner throat area 35. The burner also permits some air selectively to bypass the spin vanes 32 to reduce the pressure drop at full spin. From the throat area 35, the main combustion air then passes the primary gas injection area at the center of the burner 10 where the air flowing axially near the primary gas tube 16 is forced to change direction and move around the primary gas baffle plate 39. The main air then passes towards the secondary gas injection nozzles 21, where the air near the outside of burner tube 22 is forced to change direction around the body orifice baffle ring 36. This body orifice baffle ring 36 both increases and concentrates the spin component when the spin vanes are set to induce spin into the main combustion air as the latter passes thereover. When the burner 10 is "on oil", the deflection, caused by the body orifice baffle ring 36, of the air flow designated by the arrows J in FIG. 3 also serves to drive oil overspray designated by the letter I from the atomizer assembly 13 back into the flame.

A main body cone 42 at the end of the body tube 22 shapes and protects the flame from falling aggregate and the like as the flame leaves the burner 10. The cylindrical exit section 37 on the discharge of main body cone 42 directs and concentrates the expanding existing flame to ensure complete combustion, and prevents the flame from a tendency to go "flat", i.e. too wide. Even for high temperature industrial and thermal oxidizer applications using refractory burner block, the angle of the main body cone 42 will be present in the refractory block.

Burner 10 is ignited with a spark ignited pilot 43 (FIG. 2) in a standard manner. Likewise, the pilot 43 is monitored by a conventional UV flame scanner 44, whereas the main flame is monitored by a separate standard UV flame scanner 45. The burner 10 can also be installed in a conventional aggregate dryer via a standard-type mounting plate (not shown) integrally arranged at an appropriate place on the wall forming the flame tube 22.

By way of specific example, combustion intensities, as defined above, in a burner constructed as described above, at full spin, are around 250,000 BTU/ft$^3$ with CO readings of a magnitude associated with burners having much lower combustion intensities, e.g. 175,000 BTU/ft$^3$. Such low CO readings are indicative of complete combustion in the combustion zone. Noise reduction on the order of 12 to 14 dba have been achieved while the burner runs smoother with lower combustion sound, and less vibration in the duct work and drums to reduce metal fatigue. Low $NO_x$ levels are also obtained at the high combustion intensities and low $O_2$ levels. Moreover, the 100 million BTU/hr capacity burner built according to the present invention requires only a main fan having somewhere between 50 and 75 horsepower, and a 15 horsepower atomizer fan in contrast to previous burners which required a total horsepower, for a similar capacity, of around 125 horsepower. The burner produces a wider flame which is particularly desirable when the burner is used with larger diameter drums requiring a wider flame. Table I illustrates other scaling and design criteria of the burner over a range of capacities from 25 million BTU/hr to 170 million BTU/hr with the understanding that individual criteria may need to be varied to optimize actual performance as will be apparent to those skilled in the art.

As a result of the foregoing structure, complete mixing of fuel and air can now be achieved over a wide variety of operating conditions which equates to a more versatile combination burner.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A method for promoting rapid mixing of primary fuel and air and for obtaining a stable combustion flame at an exit of a burner, comprising the steps of:

swirling combustion air to a desired degree;

introducing at least one of a primary gaseous fuel axially into the combustion air and atomized primary liquid fuel into the burner;

providing recirculation of at least the combustion air in a recirculation region at the burner exit; and supplying a predetermined amount of substantially radially injected secondary gas into the recirculation region, when the primary gaseous fuel has been introduced downstream of a flame recirculation zone and a primary fuel supply exit near the burner exit.

2. The method according to claim 1, wherein the step of introducing atomized liquid fuel includes driving oil overspray into the flame.

3. The method according to claim 1, wherein the step of introducing atomized liquid fuel includes atomizing primary and secondary when the liquid fuel is one of propane and butane, so as to be discharged in the recirculation region.

4. The method according to claim 1, further including the step of supplying recirculation for the secondary gas.

5. A combination burner comprising a body containing means for supplying a primary fuel, means for supplying combustion air to the body, swirling apparatus operatively associated with the combustion air supplying means for swirling the combustion air, primary nozzles associated with primary fuel supplying means for introducing, in a first state in which the primary fuel is a gaseous fuel, the gaseous fuel substantially axially into the body, and secondary nozzles operatively arranged at an exit of the body to supply and mix, in the first state in which the gaseous fuel is the primary fuel, secondary gaseous fuel substantially radially toward a center of the burner for combustion with the combustion air, and a primary gas baffle ring operatively arranged on the primary fuel supplying means, which includes an atomizer arranged downstream of the primary gas baffle ring operative, in a second state of the primary fuel being a liquid fuel, for atomizing the liquid fuel wherein the primary gas baffle ring forms a flame recirculation zone and the secondary nozzles are located downstream of the primary gas baffle ring and an exit of the primary fuel supplying means.

6. The burner according to claim 5, wherein a diverging cone is arranged at the exit.

7. The burner according to claim 5, wherein the primary nozzles and the secondary nozzles are configured to provide a ratio of primary gas to secondary gas in a range of 50:50 to 20:80.

8. The burner according to claim 5, wherein the primary fuel supply means further includes an injection ring operatively arranged within the body to burn liquid propane and liquid butane fuel as the primary fuel.

9. The burner according to claim 5, wherein anchor zones are created upstream of the primary and secondary nozzles.

10. The burner according to claim 5, wherein a body orifice baffle ring is sized and located relative to the secondary nozzles to increase and concentrate a spin component of the combustion air when the gaseous fuel is the primary fuel and to drive overspray of the liquid fuel back into the flame when the liquid fuel is the primary fuel.

11. A combination burner comprising a body containing means for supplying a primary fuel, means for supplying combustion air to the body, swirling apparatus operatively associated with the combustion air supplying means for swirling the combustion air, primary nozzles associated with primary fuel supplying means for introducing, in a first state in which the primary fuel is a gaseous fuel, the gaseous fuel substantially axially into the body, and secondary nozzles operatively arranged at an exit of the body to supply and mix, in the first state in which the gaseous fuel is the primary fuel, secondary gaseous fuel substantially radially toward a center of the burner for combustion with the combustion air, and a primary gas baffle ring operatively arranged on the primary fuel supplying means, which includes an atomizer arranged downstream of the primary gas baffle ring operative, in a second state of the primary fuel being a liquid fuel, for atomizing the liquid fuel, wherein a diverging cone is arranged at the exit and a cylindrical portion is arranged downstream of the diverging cone.

12. A combination burner comprising a body containing means for supplying a primary fuel, means for supplying combustion air to the body, swirling apparatus operatively associated with the combustion air supplying means for swirling the combustion air, primary nozzles associated with primary fuel supplying means for introducing, in a first state in which the primary fuel is a gaseous fuel, the gaseous fuel substantially axially into the body, and secondary nozzles operatively arranged at an exit of the body to surly and mix, in the first state in which the gaseous fuel is the primary fuel, secondary gaseous fuel substantially radially toward a center of the burner for combustion with the combustion air, and a primary gas baffle ring operatively arranged on the primary fuel supplying means, which includes an atomizer arranged downstream of the primary gas baffle ring operative, in a second state of the primary fuel being a liquid fuel for atomizing the liquid fuel, wherein the swirling apparatus comprises adjustable blades over which the combustion air passes such that an angle of the blades can be varied.

13. A method of using a combination burner, comprising a body containing means for supplying a primary fuel, means for supplying combustion air, swirling apparatus for the combustion air, primary nozzles associated with primary fuel supplying means for introducing, when the primary fuel is a gaseous fuel, the gaseous fuel axially into the body, and secondary nozzles arranged radially at an exit of the body to supply and mix, when the gaseous fuel is the primary fuel, secondary gaseous fuel for combustion with the combustion air, and a baffle ring operatively arranged on the primary fuel supplying means, which includes an atomizer arranged downstream of the primary gas baffle ring operative, when the primary fuel is a liquid fuel, for atomizing the liquid fuel for asphalt production.

* * * * *